United States Patent [19]

Forster

[11] Patent Number: 4,464,979

[45] Date of Patent: Aug. 14, 1984

[54] DRIVE FLANGE SWASH PLATE MACHINES

[75] Inventor: Franz Forster, Muhlbach, Fed. Rep. of Germany

[73] Assignee: Linde Aktiengesellschaft, Hollriegelskreuth, Fed. Rep. of Germany

[21] Appl. No.: 375,560

[22] Filed: May 6, 1982

[30] Foreign Application Priority Data

May 13, 1981 [DE] Fed. Rep. of Germany ..... 3119033

[51] Int. Cl.[3] ..... F01B 13/04; F16H 23/00

[52] U.S. Cl. ..... 91/499; 417/222; 74/60

[58] Field of Search ..... 91/486, 487, 499, 505, 91/506, 504, 507; 417/222, 269; 92/12.2; 74/60, 839; 123/58 B, 58 BA

[56] References Cited

U.S. PATENT DOCUMENTS

| | | | |
|---|---|---|---|
| 2,297,518 | 9/1942 | Wegerdt | 91/505 |
| 2,852,320 | 9/1958 | Cornelius | 74/60 X |
| 2,967,491 | 1/1961 | Wiggermann | 91/505 |
| 3,156,192 | 11/1964 | Austin et al. | 91/507 |
| 3,331,288 | 7/1967 | Kolthoff, Jr. | 91/507 |
| 3,663,122 | 5/1972 | Kitchen | 91/499 |
| 3,789,740 | 2/1974 | Boyer | 91/486 |
| 3,862,588 | 1/1975 | Bährle et al. | 91/486 |
| 4,004,863 | 1/1977 | Porel | 417/319 X |
| 4,024,799 | 5/1977 | Forster | 91/499 |
| 4,252,508 | 2/1981 | Forster | 91/499 |

FOREIGN PATENT DOCUMENTS

| | | | |
|---|---|---|---|
| 2212895 | 9/1973 | Fed. Rep. of Germany | 417/269 |
| 1653504 | 1/1974 | Fed. Rep. of Germany | 91/499 |
| 2924135 | 1/1980 | Fed. Rep. of Germany | 91/499 |
| 1010679 | 11/1965 | United Kingdom | 91/507 |

*Primary Examiner*—William L. Freeh
*Assistant Examiner*—Paul F. Neils
*Attorney, Agent, or Firm*—Buell, Blenko, Ziesenheim & Beck

[57] ABSTRACT

A drive-flange axial piston machine is provided with a drive-flange shaft that is supported in two radial bearings supported at a distance from each other, and an axial bearing, in which case an element transmitting a torque to the shaft, preferably a gear wheel, is located on the drive-flange shaft between the radial bearings, where the axial bearing is located on the side of the element transmitting the torque, which is preferably a gear wheel, facing away from the drive flange in order to achieve as short a structural length as possible and bending-resistant components against which the bearings are supported.

6 Claims, 2 Drawing Figures

DRIVE FLANGE SWASH PLATE MACHINES

FIELD OF THE INVENTION

This invention relates to drive flange swash plate machines and particularly to drive flange axial piston machines, commonly known as drive flange swash plate merely having a drive shaft supported in bearings.

SUMMARY OF THE INVENTION

The invention concerns a drive-flange axial piston machine with a drive-flange shaft that is supported in two radial anti-friction bearings, e.g. ball or roller, supported at a distance from each other and an axial bearing, in which case an element, through which torques can be transmitted to the shaft, is located on the drive-flange shaft between the radial bearings. This element is preferably a gear wheel. In a familiar axial piston machine of this type the axial piston machine is a pump and the element transmitting the torque is a gear wheel, by which the pump is driven. The drive flange of the axial piston machine is supported against a ring, which is the inner ring to the radial bearing on the drive flange side, on the one side, and is provided with a flat sliding surface that is the sliding surface of the axial bearing, on the other side. This axial bearing is supported against a surface of the housing flange particularly designed for this purpose. The said gear wheel is located on the shaft behind this housing flange and the second radial bearing is installed on the shaft end away from the drive flange, i.e., the free end of the drive shaft. The second radial bearing is necessary for taking up the moments that arise on the drive shaft at right angles to its axis of rotation, such that the piston forces act on the drive flange at an angle deviating from 90°. The bearing flange in the housing, which supports the radial bearing and the axial bearing, must have a corresponding axial extension so that it does not bow under load on the side on which the axial bearing is supported. This requires that the gear wheel must be at a considerable distance from the drive flange, which requires that the overall pump, as was previously conventional, have a relatively great length (known as Linde twin-pump aggregates). Another arrangement with a gear wheel on the drive shaft between its two radial ball bearings is known from DE-AS No. 1653 504. In this familiar arrangement the bearing on the drive flange side is a bearing that absorbs both axial and radial forces—here as a combined axial-radial bearing—and the gear wheel is free of axial forces, because otherwise the function of this gear wheel as a pump would be jeopardized. This combined axial-radial bearing is supported through an intermediate block against a collar in the housing, in which case the gear wheel is supported in this intermediate block. It is common to all known axial piston machines that the drive flange is supported directly against a bearing which absorbs the axial thrust of the drive flange, and that the gear wheel is not loaded by this axial thrust, and that the bearing installed on the free end of the shaft, i.e., the end facing away from the drive flange, absorbs no axial forces. The arrangement of the bearing receiving the axial thrust between the drive flange and gear wheel requires a rather great structural length however. There is also the disadvantage that, in order to keep the length of the construction within tolerable limits, the structural components transmitting the forces to the axial bearing can be designed with only a limited strength, such that there is the danger that deformations occur under great forces, which result in an unfavorable absorption of the load at the axial bearing.

The present invention proposes an axial piston machine of the above-mentioned type with as short a length as possible between the drive flange and the free shaft end, in which case the design with a bearing flange that is as resistant to bending as possible should also be facilitated.

This problem is resolved according to the invention by installing the axial bearing on the side of the torque-transmitting element facing away from the drive flange, i.e., on the free end of the drive flange shaft. Because a bearing flange of sufficient size must be provided on this zone for receiving the radial bearing, this bearing flange does not increase the length of the construction. By eliminating a bearing flange that receives the axial forces in the vicinity of the drive shaft, the structural length can however be substantially reduced.

According to the invention, the element transmitting the torque, as in the familiar axial piston pumps, can be a gear wheel; however, it can also be a brake, and it is also possible to install a brake and a gear wheel in the axial direction alongside each other. As the famililar axial piston machines of this type, the axial piston machine can be a pump, but it can also be expedient, especially if a brake is provided, if the axial piston machine is a motor that drives a back-gearing gear box.

In a particularly advantageous implementation the element transmitting the torque, e.g., a gear wheel, is flat on the side facing the axial bearing and is designed to support the axial bearing directly. In this case, the great rigidity of the element, in particular, a gear wheel, is utilized in order to achieve a slight bowing in the region of the axial bearing, such that it is assured that the load distribution in the radial direction at the axial bearing is favorable and no runner canting can occur.

In a particularly advantageous design according to the invention, the inner ring of the radial bearing on the drive flange side is supported against the element transmitting the torque, preferably a gear wheel, and this element is supported directly against the axial bearing, which in turn is supported, in the bearing flange in which the second axial bearing is supported, in which case this bearing flange can be designed without difficulty so that it can take up axial forces without deformation. The present invention is not, however, restricted to this design; for example, the radial bearing on the drive flange side can also be designed so that no part of this bearing receives an axial force. For this, either the element transmitting the torque, e.g., a gear wheel, is supported lengthwise in a stable manner on the drive shaft and against the axial bearing, or a ring of the axial bearing is connected with the drive flange shaft such that the axial thrust is transmitted directly from the drive shaft to the ring of the axial bearing. This transfer can take place, for example, through a shoulder on the shaft. The design of the axial piston machine as a rocking slide pump is particularly expedient.

In the foregoing general description of this invention certain objects, purposes and advantages have been set out. Other objects, purposes and advantages of this invention will be apparent from a consideration of the following description and the accompanying drawings.

DETAILED DESCRIPTION OF THE ILLUSTRATED EMBODIMENTS

Figure 1:
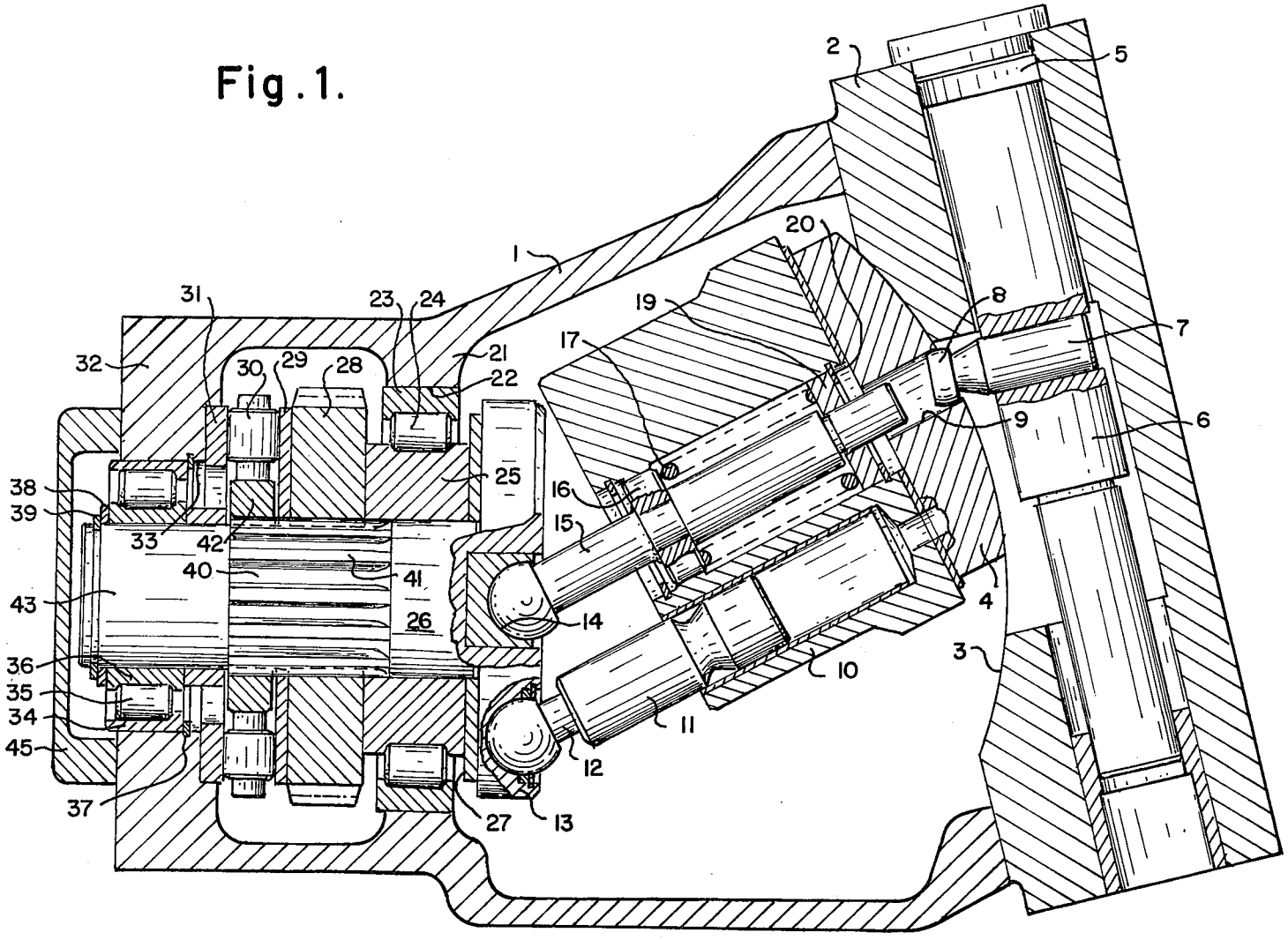
FIG. 1 is an axial section of a piston machine according to the invention.

Referring to FIG. 1 I have illustrated a housing base 2 connected with the housing 1 of a rocking slide pump in a conventional manner not shown in the drawing. The slide surface 3 for the rocking slide 4 is formed on the housing base 2 and the adjusting cylinder 5 is also formed in it. The adjusting piston 6 designed as a differential piston is capable of sliding in the adjusting cylinder 5. An adjustable pin 7, which engages with its ball end 8 into a hole 9 of the rocking slide 4, is fastened in the adjusting piston 6.

The cylinder drum 10 is supported against the rocking slide 4. The pistons 11, which are supported through a piston rod 12 against the drive flange 13, are capable of longitudinal displacement in the cylinder drum 10. An additional spherical segment 14 is provided in the axis of rotation of the drive flange 13. A center journal or stud 15 is supported in the spherical segment 14. A ring 16 on which the cylinder drum 10 is supported is supported on the center stud 15 and a spring 17 is supported against the center stud 15. The spring 17 is, on the other hand, supported against an intermediate ring 19, which is connected through a Seeger or circlip lock ring 20 with the cylinder drum 10 so that the force of spring 17 presses the cylinder drum 10 against the rocking slide 4.

A partition wall 21 is formed in the housing 1 and a hole 22 that passes all the way through is provided in the partition 21. The outer ring 23 of a radial bearing is supported in the hole 22. The bearing rollers 24 of this radial bearing run on an inner ring 25, which rides with a corresponding seat on a smooth portion 26 of the shaft. The flat backside 27 of the drive flange 13 also lies against this inner ring 25.

The inner ring 25 lies with its second flat surface against the gear wheel 28, which engages with a gear wheel lying in front of the sectional plane of the drawing and consequently is not shown in the drawing. This gear wheel 28 is flat on both its side faces and lies with the flat side opposite the inner ring 25 against a bearing plate 29, against which the roller bearings 30 run. They in turn run against a bearing ring 31 which is supported in the front flange 32 of the housing 1. A radial bearing with an outer ring 34, bearing rollers 35, and an inner ring 36 is supported in another hole 33 of the front flange 32. Although the outer ring 34 is prevented from being displaced axially toward the drive flange by a Seeger ring 37 and the inner ring 36 is prevented from being displaced in the other direction by a shim 38 and an expanding ring 39, the radial bearing 34, 35, 36 does not serve to take up axial forces. The drive flange 13 is in one piece with the drive shaft 40, which in addition to the smooth portion 26 has a toothing 41, on which both the gear wheel 28 is supported in a rotation-fast manner, but also the bearing plate 29 and the bearing cage 42, on which the bearing rollers 30 are carried. The inner ring 36 of the second radial bearing 34, 35, 36 is also supported on a smooth section 43 of the drive-flange shaft 40. This smooth section is slimmer than the section containing the toothing 42, such that it can be readily produced with a tool that runs all the way out. The cover 45 protects the bearing rollers against the penetration of dirt and also prevents the lubricant from passing out. The cover 45 is connected with the housing 1 or its flange 32 in a manner not shown in the drawing.

Owing to the oblique inclination of the forces exerted by the piston 11 on the drive flange 13 with respect to a plane normal to the axis of the drive-flange shaft 40, radial forces are exerted on the drive shaft 40 which in turn are absorbed by the bearing 23, 24, 25 and which also give rise to a moment, i.e.,a force couple, in which case the second radial force of this force couple is absorbed by the radial bearing 34, 35, 36. On the other hand, an axial force is transferred by the forces of the piston 11 to the drive flange 13 and is transmitted through the flat surface 27 of the drive flange to the inner ring 25 and from there to the gear wheel 28, from there to the bearing plate 29, from there through the bearing rollers 30 to the bearing ring 31, and from there to the bearing flange 32 of the housing 1. In spite of the short length of the construction, an unambiguous flow of force is achieved and it is assured that sufficient space is available for all the bearings and their force-receiving components to make the bearings sufficiently large. Owing to the rigidity of the gear wheel 28, the axial forces are conveyed by the inner ring 25 into the bearing plate 29 so that a bowing need not be feared at the latter and thus the bearing rollers 30 are uniformly loaded in the radial direction.

Figure 2:
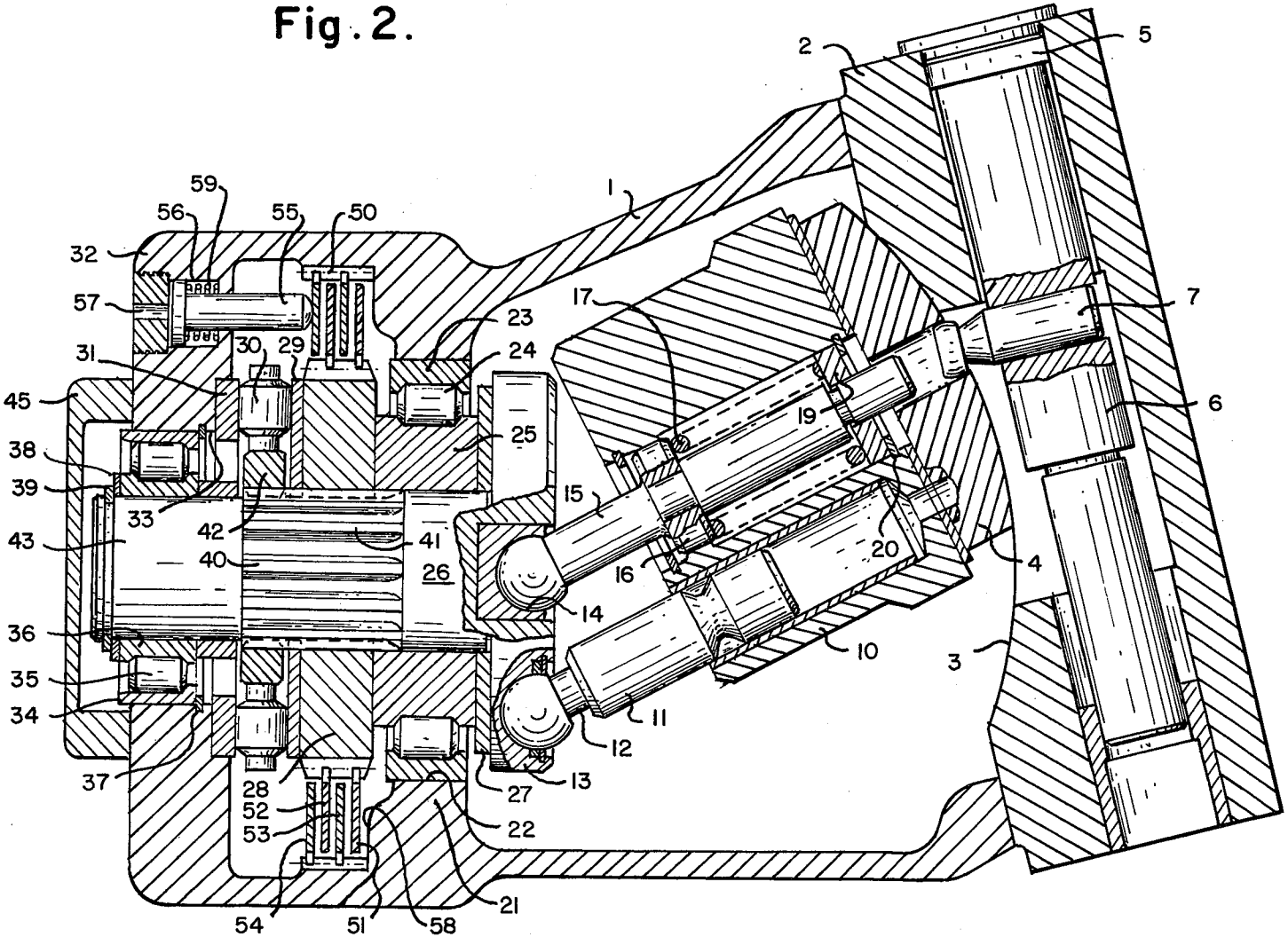
FIG. 2 is an axial section of a piston machine according to a second embodiment of the invention.

In FIG. 2 I have illustrated a second embodiment of the invention in which like elements to those of FIG. 1 bear like numbers. In this embodiment, however, two brake disks 51 and 52 are supported in axially displaceable manner on the teeth of gear 28 but engaged therewith in rotation fast manner. Disk 51 can bear against surface 58 of the housing. A brake disk 53 is located between disks 51 and 52 and brake disk 54 is located on the opposite side of disk 52 from disk 53. Disks 53 and 54 engage teeth 50 located on the housing so that disks 53 and 54 can move axially but cannot rotate relatively to the housing. A piston 55 is mounted in a cylindrical passage 56 in the housing and pressure fluid is introduced through channel 57 to force piston 55 against spring 59 and brake disk 54 to compress disks 51–54 into frictional braking engagement. When the pressure fluid is withdrawn, spring 59 returns piston 55 back into the cylinder and releases disks 51–54 out of frictional engagement.

In the foregoing specification I have set out certain preferred practices and embodiments of my invention, however, it will be understood that this invention may be otherwise embodied within the scope of the following claims.

I claim:

1. In a drive-flange axial piston machine having a housing, a rotating cylinder drum in said housing, a fluid pressure chamber in said cylinder drum, a piston reciprocable in said fluid pressure chamber and a drive-flange shaft rotating with said cylinder drum, the improvement comprising a pair of radial bearings supporting said shaft at longitudinally spaced positions in said housing, a separate torque transmitting element spaced from the drive-flange and axially movable and engageable on said shaft intermediate said radial bearings, and an axial bearing between said torque transmitting element and said housing located on the side of the torque transmitting element opposite the drive flange and carrying the axial thrust of the drive flange through the torque transmitting element.

2. Drive-flange axial piston machine according to claim 1, characterized in that the element transmitting the torque is a gear wheel.

3. Drive-flange axial piston machine according to claim 1, characterized in that the element transmitting the torque is a brake.

4. Drive-flange axial piston machine according to claim 1 or 2 or 3, characterized in that the inner ring of the radial bearing on the drive flange side of the torque transmitting element is supported against the torque transmitting element and that this torque transmitting element is supported against the axial bearing, which in turn is supported in the bearing flange in which the other radial bearing is supported.

5. Axial piston machine according to claim 2 or claim 3, characterized in that the element transmitting the torque is flat on the side facing the axial bearing and is designed to support the axial bearing.

6. Drive-flange axial piston machine according to claim 5, characterized in that the inner ring of the radial bearing on the drive flange side of the torque transmitting element is supported against the torque transmitting element and that this torque transmitting element is supported against the axial bearing, which in turn is supported in the bearing flange in which the other radial bearing is supported.

* * * * *